US005530730A

United States Patent [19]

Takemoto et al.

[11] Patent Number: 5,530,730

[45] Date of Patent: Jun. 25, 1996

[54] MEDAL COUNTER FOR COUNTING MEDALS USED IN GAME MACHINE

[75] Inventors: Takatoshi Takemoto; Koichi Tsubota; Masao Minagawa, all of Tokyo; Moriyuki Aoyama, Chiryu, all of Japan

[73] Assignee: Kabushiki Kaisha Ace Denken, Japan

[21] Appl. No.: 354,517

[22] Filed: Dec. 13, 1994

[51] Int. Cl.[6] ..... G07D 5/00

[52] U.S. Cl. ..... 377/7; 377/5; 453/32; 453/58

[58] Field of Search ..... 377/6, 7; 453/32, 453/58

[56] References Cited

U.S. PATENT DOCUMENTS

| | | | |
|---|---|---|---|
| 3,242,932 | 3/1966 | Becker | 377/7 |
| 3,757,805 | 9/1973 | Puhahn et al. | 453/58 |
| 3,848,614 | 11/1974 | Conant et al. | 377/7 |
| 5,190,495 | 3/1993 | Taxon | 453/32 |
| 5,232,398 | 8/1993 | Maki | 453/57 |
| 5,244,207 | 9/1993 | Laatikainen | 453/32 |

FOREIGN PATENT DOCUMENTS 2-48938 12/1990 Japan .

2258076 1/1993 United Kingdom .

*Primary Examiner*—John S. Heyman

*Attorney, Agent, or Firm*—Andrus, Sceales, Starke & Sawall

[57] ABSTRACT

A medal counting apparatus installed in a game parlor for counting medals which a game player has won, is disclosed. The medal counting apparatus comprises a counter for counting the medals, a medal supplying mechanism for receiving the medals to be dumped and for supplying them sequentially to the counter, a dump restraining unit for restraining the medals from being dumped into the medal supplying mechanism and a control unit for controlling operations of the medal supplying mechanism and the dump restraining unit. The medal supply control means puts the medal supplying mechanism into a stopped state when the dump restraining unit restrains the medals from being dumped and into an operation state when the dump restraining unit permits dumping of the medals. The control unit also instructs the dump restraining unit to close the receiving hopper when a medal dump restraining signal is input from the outside or the counter has not been used for a certain period of time. When there is a request to dump medals, the control unit then instructs the dump restraining, unit to open the receiving hopper.

19 Claims, 13 Drawing Sheets

MEDAL COUNTER FOR COUNTING MEDALS USED IN GAME MACHINE

BACKGROUND OF THE INVENTION

1. Field of the Invention

The present invention relates to a medal counting apparatus installed in a game parlor for counting medals which a game player has won, and more particularly to a medal counting apparatus whose power consumption may be reduced.

2. Description of the Related Art

In a game parlor provided with game machines, such as slot machines which use medals as game media, a large number of medals which a game player has won are usually exchanged for a prize or the like, corresponding to the number of medals. While the medals have to be counted at that time, it takes time and are likely to be miscounted if a very large number of medals are to be counted manually. For this reason, there has been a demand for the development of a medal counting apparatus which automatically counts the medals.

In automating the medal counting, procedure, however, there are some potential problems. Firstly, a driving section of the apparatus may be overloaded since a large number of medals might be dumped in it when counting the medals. Considering the convenience in handling the medals, it is preferable for the player to be able to dump the large number of medals at once when counting the medals. For the counting apparatus, however, a large starting torque is required particularly at a medal receiving section, and there is no alternative but to enlarge the mechanism and motor for the drive, if the apparatus is to be started for the execution of operations such as selection and counting of the medals when a large number of medals are dumped. To deal with such problem, it is conceivable to keep the motor and others always in a drive state. In such a case, however, another problem occurs, namely that power is wasted and noise or the like is generated continually.

Secondly, the apparatus automatically counts up not only genuine medals but also non-genuine medals, e.g., medals having a different diameter which are mixed in with the genuine medals. Particularly, medals having a smaller diameter pose a problem in that they are hard to exclude.

SUMMARY OF THE INVENTION

Accordingly, it is a primary object of the present invention to provide a medal counting apparatus which can put a driving source of the apparatus into an operating state when dumping of medals is permitted and slow down or stop the operation of the driving source when the dumping of medals is not permitted and which can, thereby, reduce a starting torque, which results in downsizing of the driving source and reduced power.

It is another object of the present invention to provide a medal counting apparatus which can count medals while selecting and removing medals having a smaller diameter.

In order to achieve the primary object described above, according to a first aspect of the present invention, there is provided a medal counting apparatus for counting dumped medals, comprising: a counter for counting the medals; a medal supplying mechanism for receiving the medals to be dumped and for supplying them sequentially to the counter; counter control means for controlling a counting operation of the counter; a dump restraining unit for restraining the medals from being dumped into the medal supplying mechanism; and a control unit having medal supply control means for controlling the operation of the medal supplying mechanism and dump restraining control means for controlling the operation of the dump restraining unit; the medal supply control means putting the medal supplying mechanism into a stopped state when the dump restraining unit restrains the medals from being dumped and into an operating state when the dump restraining unit permits the medals to be dumped.

In order to achieve the above-mentioned second object, according to a second aspect of the present invention, there is provided a medal counting apparatus for counting dumped medals, comprising: a counter for counting the medals while selecting them; and a medal supplying mechanism for sequentially supplying the dumped medals to the counter; the counter comprising a selection path for excluding small medals and a counting section for counting medals which have passed through the selection path; the selection path comprising: a pair of guide members disposed so that a space between the guide members is insufficient for genuine medals to drop therethrough but is sufficient to allow the small medals to drop, for guiding the medals by placing them on the guide members in a flat state; a pair of guide plates which are disposed respectively outside of the pair of guide members with a space permitting the genuine medals to pass through; and a roller and its driving mechanism disposed above the pair of guide members to send the medals along the guide members; the medal supplying mechanism comprising: a receiving hopper having an opening into which the medals are dumped and then sent out from the opening bit by bit; and counting hopper for receiving the medals sent from the receiving hopper and sending them to the counter one by one.

The above and other related objects and features of the invention will be apparent from the following description of the disclosure read in conjunction with the accompanying drawings and the novelty thereof pointed out in the appended claims.

DETAILED DESCRIPTION OF PREFERRED EMBODIMENT

Figure 1:
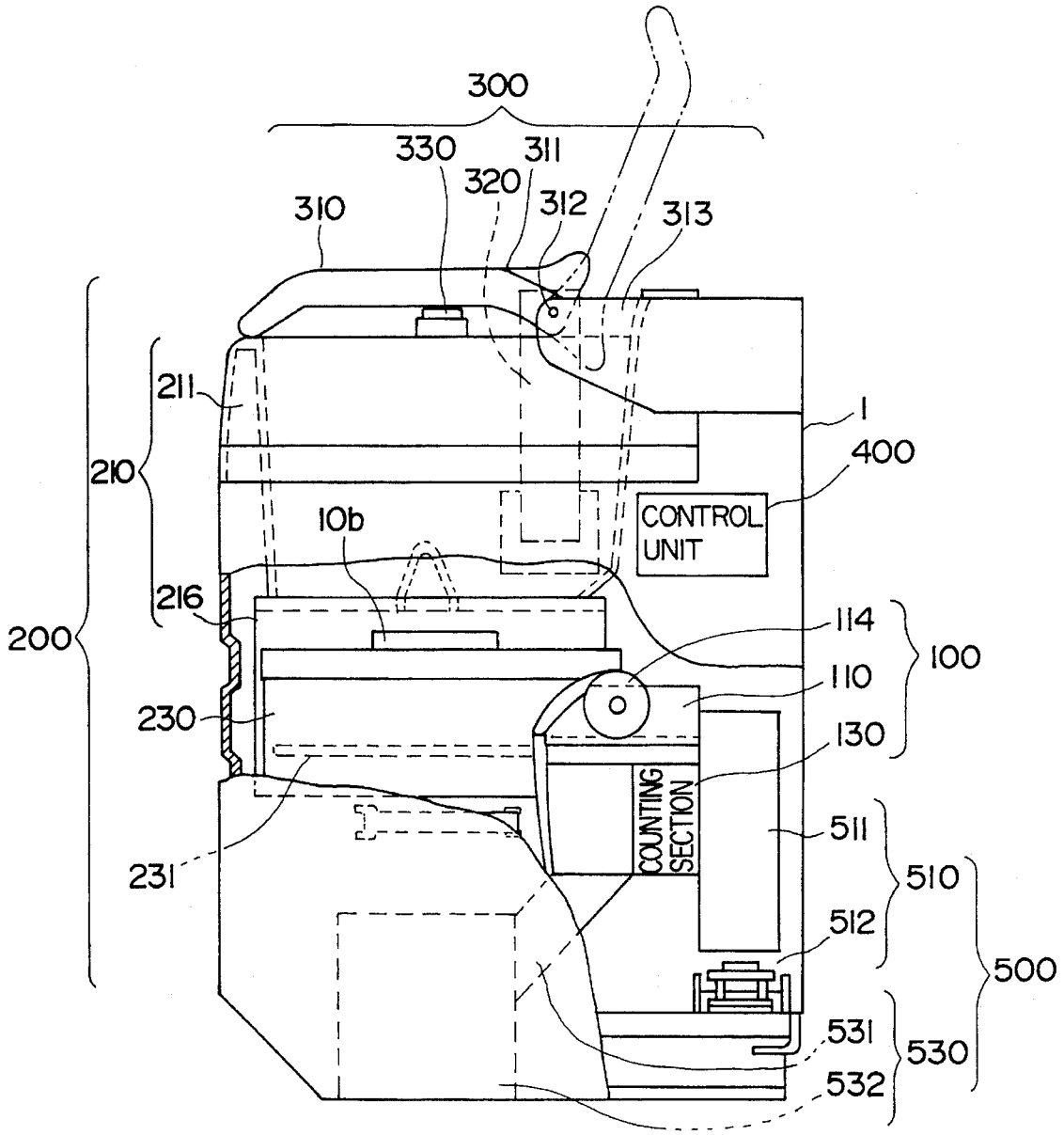
FIG. 1 is a side view illustrating the whole of a medal counting apparatus of the invention by breaking away a part thereof.

Referring now to the drawings, a preferred embodiment of the present invention will be explained. It should be noted that the present invention is not restricted to only the embodiment described below.

Figure 2:
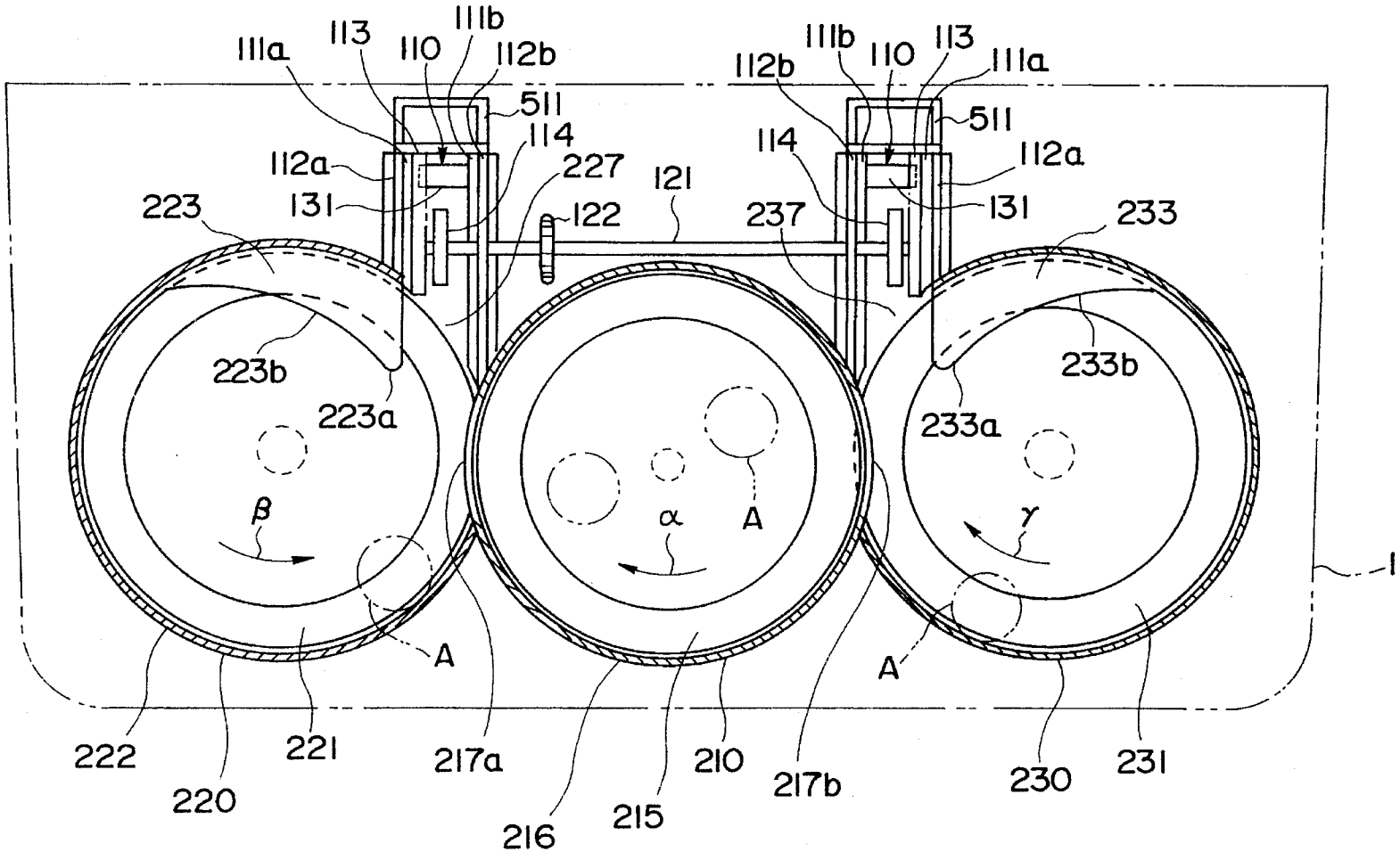
FIG. 2 is a plan view illustrating a main part of the medal counting apparatus of the invention by breaking away a part thereof.
Figure 3:
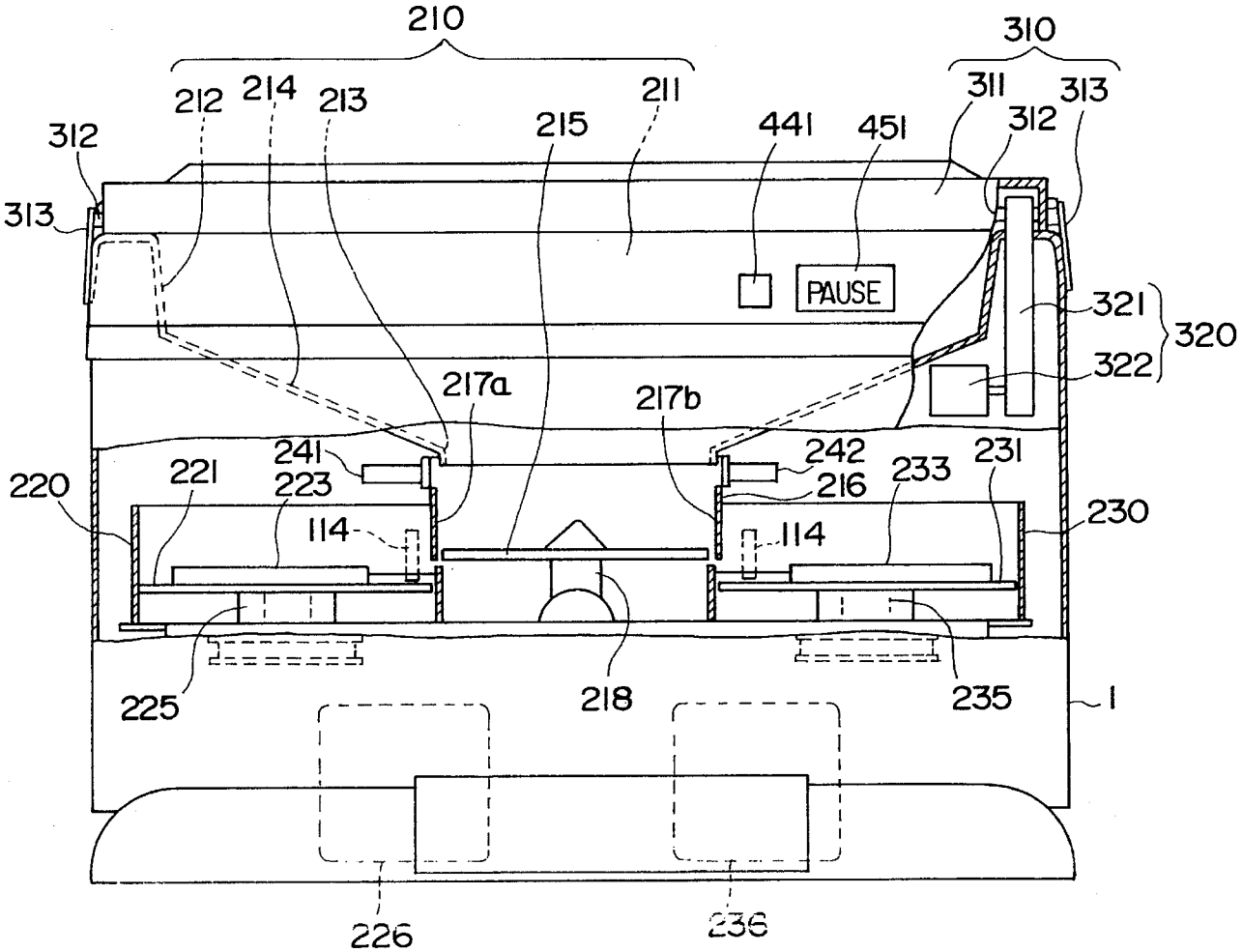
FIG. 3 is a front view illustrating the whole medal counting apparatus of the invention by breaking away a part thereof.
Figure 7A:
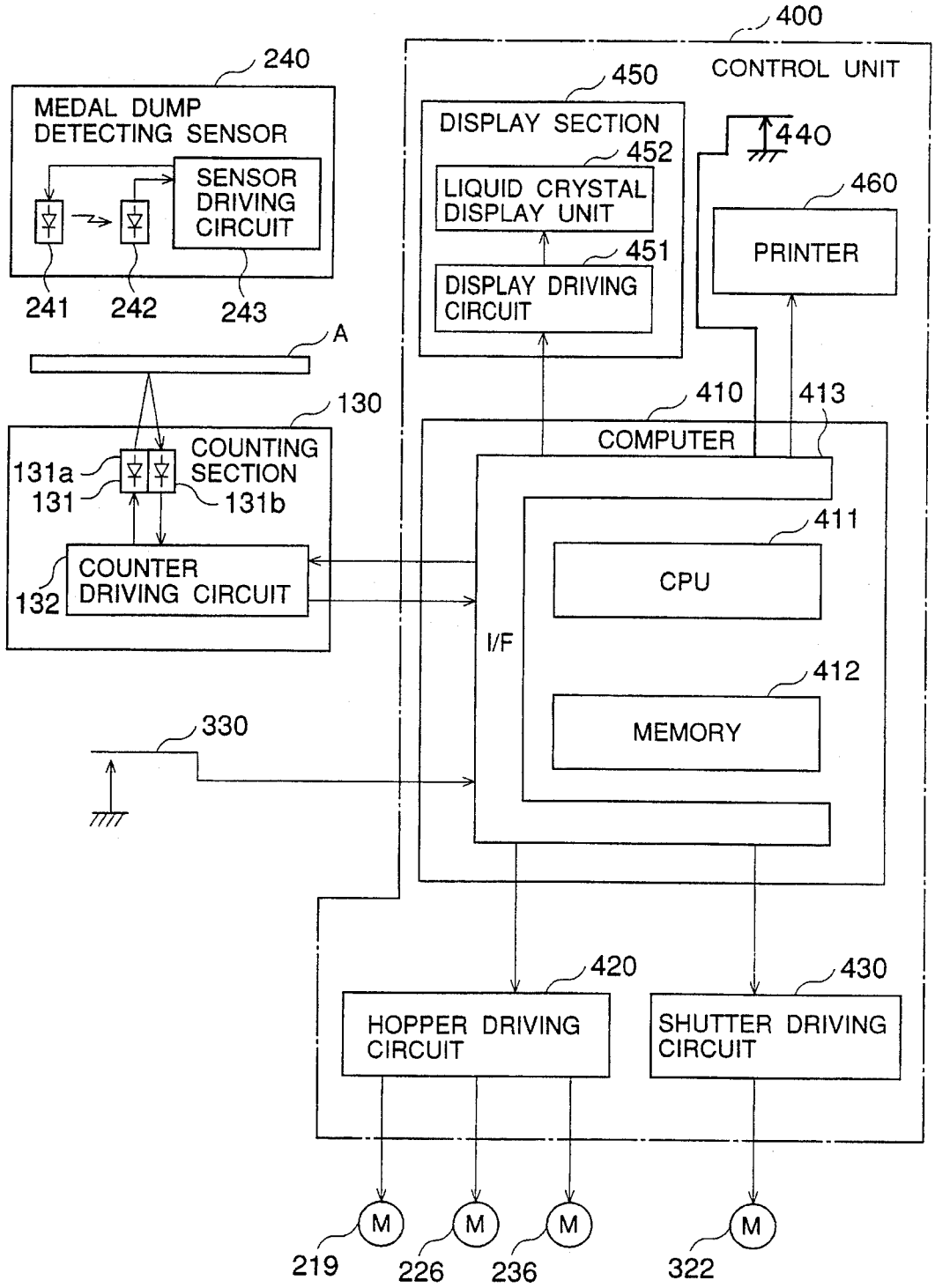
FIG. 7A is a block diagram illustrating one example of an arrangement of hardware resources of a control unit used in the present invention.
Figure 7B:
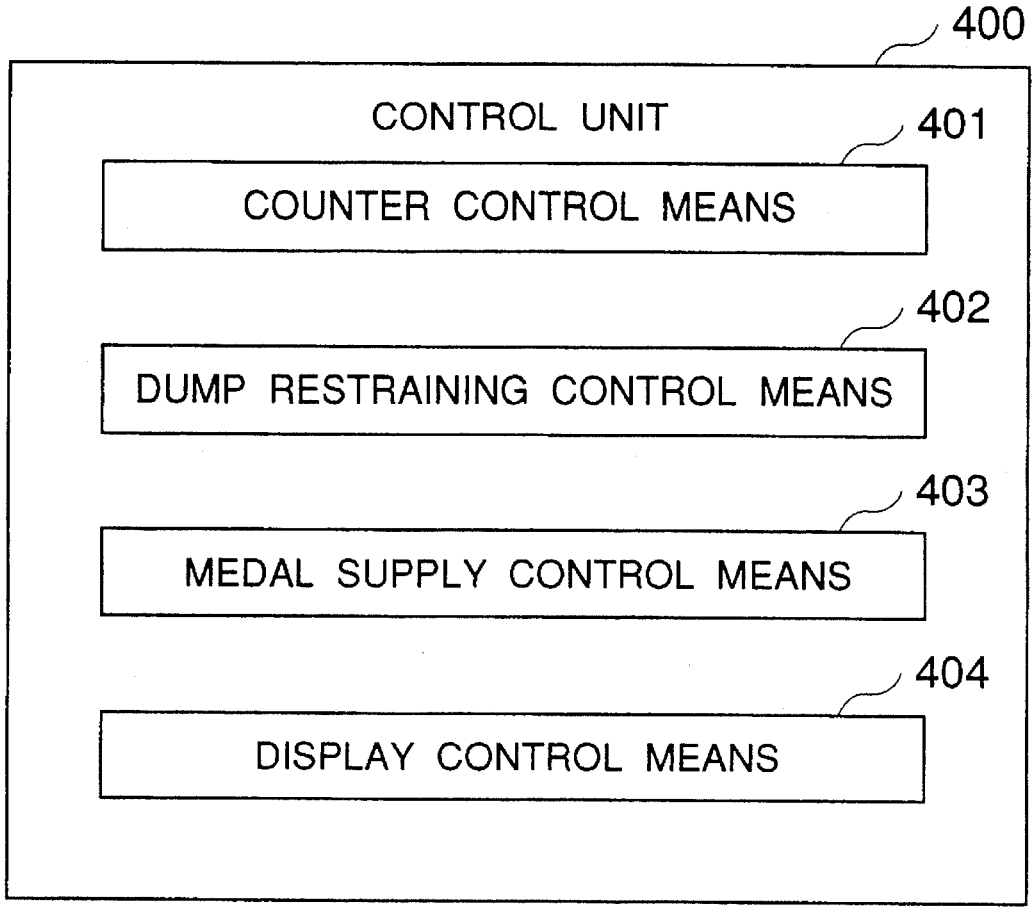
FIG. 7B is a block diagram illustrating a functional structure of the control unit used in the present invention.

As shown in FIGS. 1 through 3 and in FIGS. 7A and 7B, a medal counting apparatus of the present invention comprises a counter 100 for counting medals, a medal supplying mechanism 200 for receiving medals to be dumped and for supplying them sequentially to the counter 100, a dump restraining unit 300 for restraining the medals from being dumped into the medal supplying mechanism 200, a control unit 400 for controlling operations of the medal supplying mechanism 200 and dump restraining unit 300 and a medal handling mechanism 500 for handling medals discharged from the counter 100. These components are all accommodated in a case 1.

As shown in FIGS. 2 and 3, the medal supplying mechanism 200 comprises a receiving hopper 210 for sending out the dumped medals bit by bit, counting hoppers 220 and 230 for receiving the medals sent from the receiving hopper 210 and sending them to the counter 100 one by one, and a medal dump detecting sensor 240 (see FIG. 7A) for detecting that the medals have been dumped into the receiving hopper 210.

As shown in FIG. 3, the receiving hopper 210 has a dump section 211 for receiving the dumped medals and for adjusting an amount of dumped medals to be discharged, a rotary disc 215, disposed under the dump section 211, for sending the medals dumped into the dump section 211 to the counting hoppers 220 and 230, a driving mechanism 218 and a motor 219 (see FIG. 7A) which is a driving source. The dump section 211 is formed into a cylindrical shape having a slope 214 at a part thereof. It has an opening 212, into which medals are dumped, at the upper part thereof and a discharge port 213 for dropping the dumped medals onto the rotary disc 215 at the lower part thereof.

The rotary disc 215 is rotated in one direction, e.g., clockwise, by a driving mechanism (not shown). As a result, the medals placed on it are discharged from the discharge port 213 as a result of its centrifugal force. The rotary disc 215 has a cylinder 216, at the outer periphery thereof, which surrounds a space at the upper part of the rotary disc 215. An upper opening of the cylinder 216 communicates with the discharge port 213. The cylinder 216 is provided with discharge ports 217*a* and 217*b* respectively at the sections neighboring the counting hoppers 220 and 230. The medals are sent to each of the counting hoppers 220 and 230 through the discharge ports 217*a* and 217*b*. By the way, freely openable shutters may be provided at those discharge ports 217*a* and 217*b*.

The counting hoppers 220 and 230 are disposed at locations to the right and left of the receiving hopper 210 and below the rotary disc 215. That is, they are disposed at the locations where they can receive the medals in the receiving hopper 210 when they are discharged through and dropped from the discharge ports 217*a* and 217*b*. The structure of the counting hoppers 220 and 230 are basically the same, except that they are bisymmetrical, i.e. constructed to reflect the right and left locations of the hoppers.

The counting hopper 220 (230) comprises a rotary disc 221 (231), a cylinder 222 (232) which surrounds an upper space thereof, a guide plate 223 (233) for guiding medals, a driving mechanism 225 (235) for turning the rotary disc 221 (231) and a motor 226 (236) which is a driving source. The cylinder 222 (232) is provided with a counter connecting section 227 (237) adjoining the discharge port 217*a* (217*b*) of the receiving hopper 210. The counter 100 is linked to the counter connecting section 227 (237). The guide plate 223 (233) is disposed adjoining the counter connecting section 227 (237) and comprises a projection 223*a* (233*a*) projecting in the center direction of the rotary disc 221 (231) on the downstream side of the counter connecting section 227 (237) and a bend 223*b* (233*b*) following the projection. The projection 223*a* (233*a*) captures the medals placed on the rotary disc 221 (231) at locations separated from the outer periphery thereof to guide them to the counter connecting section 227 (237).

The rotary disc 221 (231) is turned by the motor 226 (236) through the intermediary of the drive mechanism 225 (235). In the present embodiment, the rotary disc 221 is turned counterclockwise and the rotary disc 231 is turned clockwise. However, those rotary discs 221 and 231 may be turned respectively in the opposite direction. The medals are sent to the counter connecting section 227 (237) by a centrifugal force caused by the rotation of the rotary disc 221 (231). The counter connecting section 227 (237) is disposed so that the medals move in the direction tangential to the rotary disc 221 (231).

As shown in FIG. 7A, the medal dump detecting sensor 240 has a light emitting element 241, a light receiving element 242 and a sensor driving circuit 243 for driving them to detect that medals have been dumped. The light emitting element 241 is made of a light emitting diode for example. The light receiving element 242 is made of a photo diode for example. The light emitting element 241 and light receiving element 242 are disposed at the sides of the cylinder 216 of the receiving hopper 210 in a manner facing each other. As a result, the medals dumped into the receiving hopper 210 and sent from the discharge port 213 to the rotary disc 215 are optically detected. By the way, it is preferable to widen a field of view of the light emitting element 241 and light receiving element 242 so as to be able to reliably detect even a small number of medals. A plurality of sets of light emitting element 241 and light receiving element 242 may be disposed, as necessary. An output of the sensor driving circuit 243 is transmitted to the control unit 400.

As shown in FIG. 1, the counter 100 is provided with a selection path 110 for removing medals having a small diameter and a counting section 130 for counting medals that have passed through the selection path 110.

Figure 4:
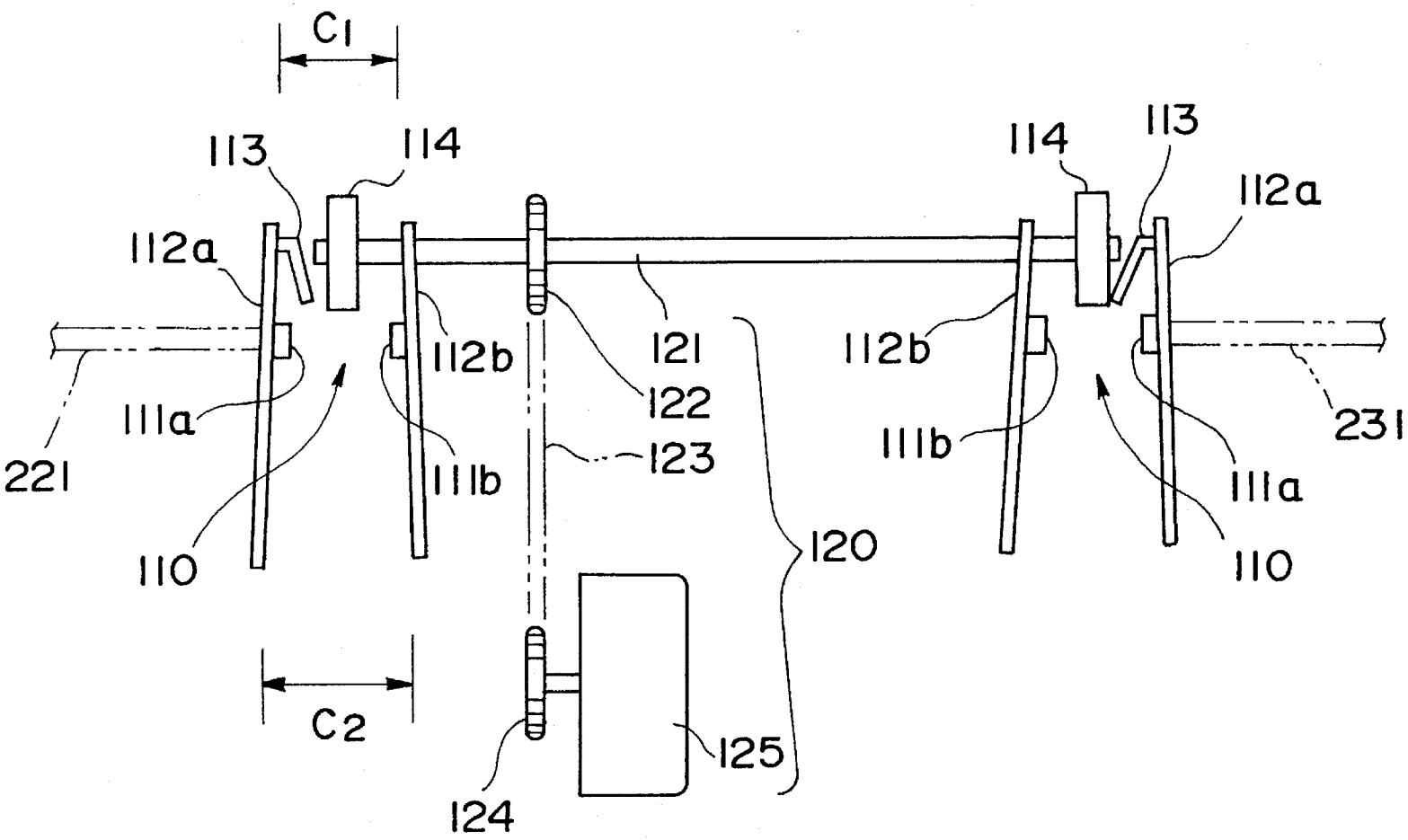
FIG. 4 is a front view illustrating a structure of a selection path which is a component of a counter used in the medal counting apparatus of the invention.
Figure 5:
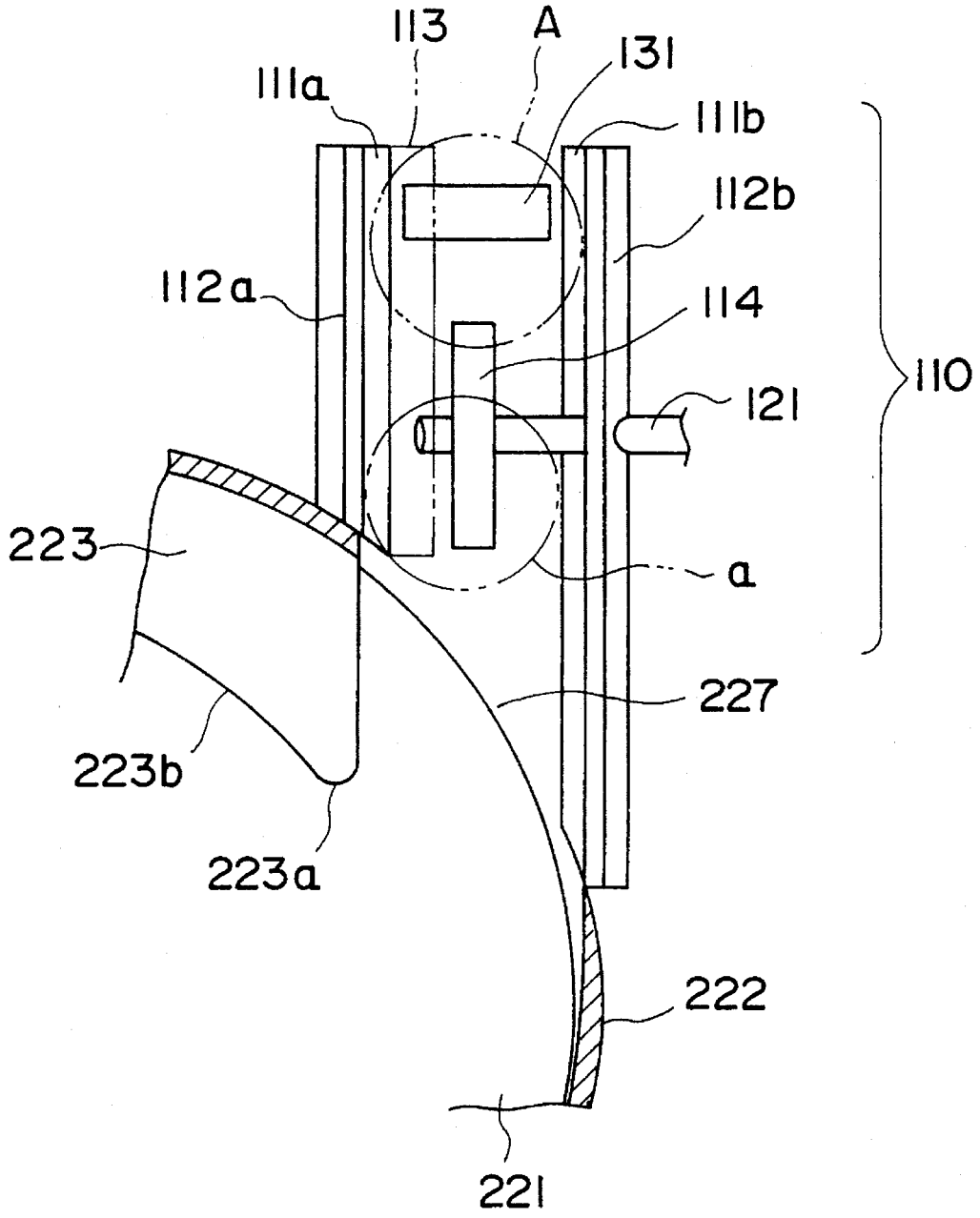
FIG. 5 is an enlarged plan view illustrating a portion of the medal counting apparatus shown in FIG. 1.

As shown in FIGS. 4 and 5, the selection path 110 comprises a pair of guide members 111*a* and 111*b* for guiding medals by placing them on the guide members in a flat state, a pair of guide plates 112*a* and 112*b* disposed respectively on the outside of the pair of guide members 111*a* and 111*b* with a space which permits genuine medals to pass through, a roller 114 and its drive mechanism 120 disposed above the pair of guide members 111*a* and 111*b* to send the medals along the pair of guide members 111*a* and 111*b* and a pressing member 113 disposed above the pair of guide members 111*a* and 111*b*.

The pair of guide members 111*a* and 111*b* are provided convexly on the opposed faces of the guide plates 112*a* and 112*b* . They are disposed so that a space between them is insufficient for genuine medals to drop therethrough but is sufficient to allow the small medals to drop. The guide plates 112*a* and 112*b* are disposed in a manner inclining toward each other so that an upper space thereof becomes narrower than a lower space thereof as shown in FIG. 4. In the example shown in FIG. 4, the upper space C1 is set to be narrower than a diameter of the genuine medals and the lower space C2 to be wider than that. Thereby, the width of the space under the guide members 111*a* and 111*b* becomes wide, allowing smaller medals to be readily discharged.

The pressing member 113 is provided across almost the whole length of the selection path 110. The pressing member 113 prevents the medals on the guide members 111*a* and 111*b* from rising. Thereby, the medals may be selected in a correct posture. By the way, another member may be used for pressing medals so long as it functions in the same manner of the pressing member 113.

Figure 6B:
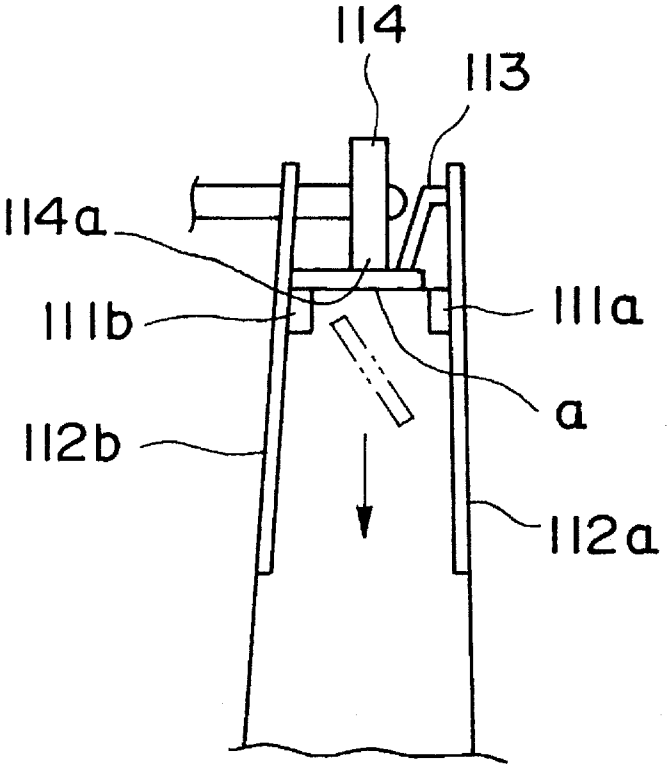
FIG. 6B is a front view showing a state in which a small medal is sent through the selection path shown in FIG. 4.
Figure 6A:
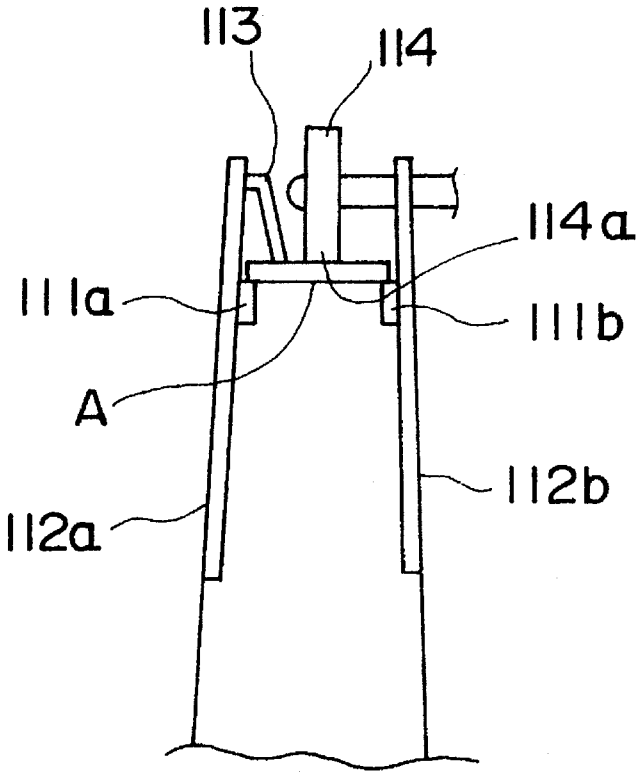
FIG. 6A is a front view showing a state in which a genuine medal is sent through the selection path shown in FIG. 4.

The roller 114 is disposed at the position on the base side of the selection path 110 and between the guide members 111*a* and 111*b* as shown in FIG. 5. As shown in FIGS. 6A and 6B, the roller 114 is set at a height which allows an outer periphery 114*a* thereof to contact with the medal and send it along the guide members 111*a* and 111*b*.

The driving mechanism 120 for driving the roller 114 is provided in common for the selection paths 110 provided for each of the counting hoppers 220 and 230. That is, as shown in FIG. 4, the driving mechanism 120 comprises a drive shaft 121 provided across the two selection paths 110 provided abreast, a gear 122 disposed at the intermediate section of the drive shaft 121, a motor 125 for driving the drive shaft 121, a gear 124 attached to a rotary shaft of the motor 125 and a chain 123 provided across the gears 122 and 124. The rollers 114 are mounted on both ends of the drive shaft 121. Accordingly, the motor 125 rotates the rollers 114 by driving the drive shaft 121.

As shown in FIGS. 1 and 2, the counting section 130 is disposed at the position on the edge of the selection path 110, and below and between the guide members 111*a* and 111*b*. As shown in FIG. 7A, the counting section 130 has a medal detecting sensor 131 for detecting a presence of medals and a counter driving circuit 132 for driving the medal detecting sensor 131 and for processing an output signal of the medal detecting sensor 131 to count medal detection signals. The counter driving circuit 132 transmits the count result to the control unit 400 and is reset by the control unit 400 after finishing the counting.

As shown in FIGS. 1 and 3, the dump restraining unit 300 comprises a shutter 310 for opening/closing the opening 212 of the receiving hopper 210, its driving mechanism 320 and a shutter closure detecting sensor 330 for detecting at least that the shutter 310 is closed.

The shutter 310 comprises a shutter plate 311 made of a plate-like member having a shape and area capable of covering the opening 212 of the receiving hopper 210, a shaft member 312 fixed to the shutter plate 311 and a bearing section 313 for supporting the shaft member 312 in such a manner as to freely open and close it.

The driving mechanism 320 comprises a power transmission mechanism 321 and a motor 322. The power transmission mechanism 321 is constructed by a gear mechanism for example. The motor 322 is linked to an input side of the power transmission mechanism 321. An output side of the power transmission mechanism 321 is linked to the shaft member 312 to give a rotary driving force to the shaft member 312.

The shutter closure detecting sensor 330 is constructed by a micro-switch for example. When the shutter plate 311 is closed, the shutter closure detecting sensor 330 is pressed by the plate 311 and is turned ON and when the shutter plate 311 starts to open, it is turned OFF. An output of the shutter closure detecting sensor 330 is input to the control unit 400.

As shown in FIG. 7A, the control unit 400 comprises a computer 410, a hopper driving circuit 420, a shutter driving circuit 430, a start requesting switch 440, a display section 450 and a printer 460. The computer 410 comprises a central processing unit (CPU) 411 for executing information processing for the control, a memory 412 for storing a program for the CPU 411, data and the like and an interface 413. The hopper driving circuit 420 controls operations of the motors 219, 226 and 236 by receiving instructions from the computer 410. The shutter driving circuit 430 controls the operations of the motor 322 by receiving instructions from the computer 410. The start requesting switch 440 is constructed as a press-button switch for example and when it is pressed, it turns ON and outputs a medal dump requesting signal. A manipulation section 441 of this press-button switch is disposed at the upper front section of the case 1 for example as shown in FIG. 3. The display section 450 is composed of a panel display unit, or more specifically, a liquid crystal display 452 and a display driving circuit 451.

The CPU 411 functions as counter control means 401 for controlling the operation of the counter 100, dump restraining control means 402 for controlling the operation of the dump restraining unit 300, medal supply control means 403 for controlling the operation of the medal supplying mechanism 200 and display control means 404 for controlling display of the display section 450 and the printer 460, respectively as shown in FIG. 7B, by executing procedures shown in flowcharts in FIGS. 8 through 11 described later.

The counter control means 401 resets the counter driving circuit 132 of the counter 100. It also reads the count result, outputs the result to the display section 450 and sends it to the printer 460 to issue a receipt. Furthermore, the counter control means 401 adds the count result to an accumulated value till then and stores it in the memory 412 to update the accumulated value.

When a medal dump restraining signal is input from the outside, the dump restraining control means 402 instructs the dump restraining unit 300 to close the opening 212 of the receiving hopper 210. Furthermore, when the receiving hopper 210 and the counting hoppers 220 and 230 are in an operating state in which power consumption is reduced and when the medal dump detecting sensor 240 has not detected any dumped medal successively for a predetermined period of time, the dump restraining control means 402 instructs the dump restraining unit 300 to close the opening 212 of the receiving hopper 210. On the other hand, when a medal dump requesting signal is input from the outside, the dump restraining control means 402 instructs the dump restraining unit 300 to open the shutter 310. At this time, when the medal dump restraining signal is input from the outside, the dump restraining control means 402 stops accepting the input of the medal dump requesting signal from the outside until the medal dump restraining signal is released. The above-mentioned predetermined time may be appropriately set, for example five minutes.

By the way, the dump restraining control means 402 may omit the operation in which the power consumption is reduced. That is, when the medal dump detecting sensor 240 has not detected any dumped medal successively for a predetermined time, e.g., 10 minutes, the dump restraining control means 402 may instruct the dump restraining unit 300 to close the opening 212 of the receiving hopper 210.

Further, the dump restraining control means 402 may be adapted to make a decision to stop the operation upon condition that the counter 100 has not executed any counting operation successively for a predetermined period of time. It is of course possible to adopt both conditions, namely that the medal dump detecting sensor 240 has not detected any dumped medal and that the counter 100 has not executed any counting operation successively for a predetermined period of time, as the condition for the determination.

When the dump restraining unit 300 is restraining medals from being dumped, the medal supply control means 403 puts the medal supplying mechanism 200 into a stopped state and when the dump restraining unit 300 permitting the dumping of the medals, it puts the medal supplying mechanism 200 into the operation state. There are two states in this operation state: a normal operation state and a low power consumption operation state in which the medal supplying mechanism 200 is operated by slowing down the motors. The normal operation state is an operation state in which the dumped medals are received and are sent to the counter. On the other hand, the low power consumption operation state is an operation state in which the operation of the medal supplying mechanism 200 is slowed down to reduce the power consumption when no dumped medal has been detected by the medal dump detecting sensor 240 for a predetermined period of time in the above-mentioned normal operation state. At this time, the operation is not completely stopped so that a large starting torque is not necessary when medals are dumped.

Furthermore, the medal supply control means 403 takes in the output signal of the shutter closure detecting sensor 330 and switches the state of the receiving hopper 210 and the counting hoppers 220 and 230 from the stopped state to the operation state when the shutter starts to open.

The medal supply control means 403 has two modes as modes for putting the operation of the medal supplying mechanism 200 into the stopped state. The first mode is an operation stop mode for the case when the medal dump restraining signal is input from the outside. In this mode, the medal supply control means 403 takes in the output signal from the shutter closure detecting sensor 330 to monitor whether the shutter plate 311 has been closed or not since the instruction to close the shutter was issued, as will be described later with reference to FIG. 11. If the medal dump detection signal is input from the medal dump detecting sensor 240 after that, the process for counting the dumped medals is carried out. When no medal has been dumped and when the above-mentioned counting process has been finished, the operation of the medal supplying mechanism 200 is stopped. The second mode is a mode of stopping the medal supplying mechanism 200 in the low power consumption operation state. That is, under this mode, if no medal has been dumped successively for a predetermined period of time while the medal supplying mechanism 200 has been operated in the low power consumption operation state, the operation of the medal supplying mechanism 200 is stopped with the above-mentioned first procedure.

When the receiving hopper 210 and the counting hoppers 220 and 230 are in the low power consumption operation state and when the medal dump detecting sensor 240 detects that medals have been dumped, the medal supply control means 403 puts the receiving hopper 210 and the counting hoppers 220 and 230 into the normal operation state.

By the way, the medal supply control means 403 may stop the operation of the receiving hopper 210 and the counting hoppers 220 and 230 when the counter 100 does not execute any counting operation successively for a predetermined period of time after taking in the output signal of the shutter closure detecting sensor 330 and closing the shutter plate 311. The successive time here may be determined by a time necessary for finishing counting when medals are dumped just before the shutter plate 311 is closed. Generally, the counting of medals is finished in several tens of seconds in a fast case or within one minute at most even in a longer case. Accordingly, the successive time here may be determined within a range of 30 seconds to one minute for example.

When the counter 100 has not executed any counting operation successively for a predetermined period of time and when the medal dump detecting sensor 240 has not detected that any medal was dumped, the medal supply control means 403 may put the receiving hopper 210 and the counting hoppers 220 and 230 from the normal operation state to the low power consumption operation state.

The display control means 404 controls the display section 450 to indicate the states of the counting apparatus. For example, it displays such messages as "Press Start Button", "Operational", "Counting" and "Pause". Display data for displaying such messages is stored in the memory 412. The display control means 404 also displays a count result, i.e., a counted value. Furthermore, the display control means 404 displays an indication when a problem occurs in the apparatus. Beside that, it controls an output of the printer 460. The printer 460 is used mainly to print out the count result and a guide message for a customer.

As shown in FIG. 1, the medal handling mechanism 500 comprises a genuine medal handling section 510 for handling genuine medals after counting and a small medal handling section 530 for handling small medals.

The genuine medal handling section 510 has a chute 511 for guiding medals selected as genuine medals in the selection path 110 and a conveyer 512 for conveying the medals carried over via the chute 511. The conveyer 512 conveys the medals to medal dispensers, game machines or the like. When the medals are not reused, the conveyer 512 conveys them to a safe box for example. By the way, the conveyer 512 may be replaced with a tank.

On the other hand, the small medal handling section 530 comprises a chute 531 disposed under the selection path and a tank 532. The small medals are stored in the tank 532 considering that they are relatively small in number and that they cannot be reused. They may be of course conveyed by a conveyer.

Next, the operation of the medal counting apparatus of the present invention will be explained with reference to FIGS. 8 through 11.

When the medal counting apparatus of the invention is not activated, the shutter plate 311 is closed as shown by solid lines in FIG. 1. When the medal counting apparatus is used, a power switch (not shown) is initially turned on. Then, power is supplied to each part of the apparatus from a power unit (not shown) and along with that, the control unit 400 is activated.

Figure 8:
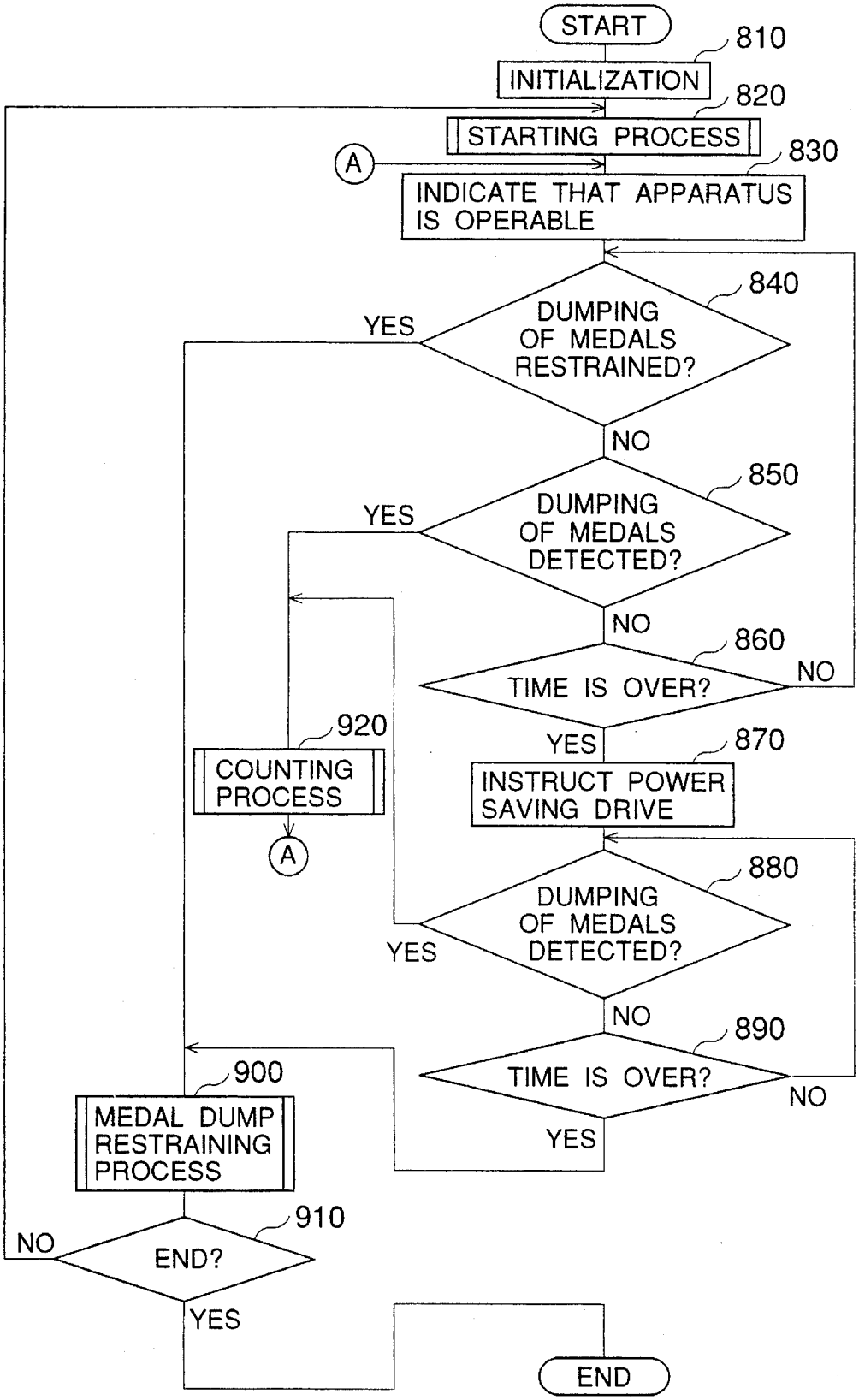
FIG. 8 is a flowchart showing control operations of the control unit.

When the control unit 400 is activated, it initializes (Step 810) and executes a starting process (Step 820) as shown in FIG. 8.

Figure 9:
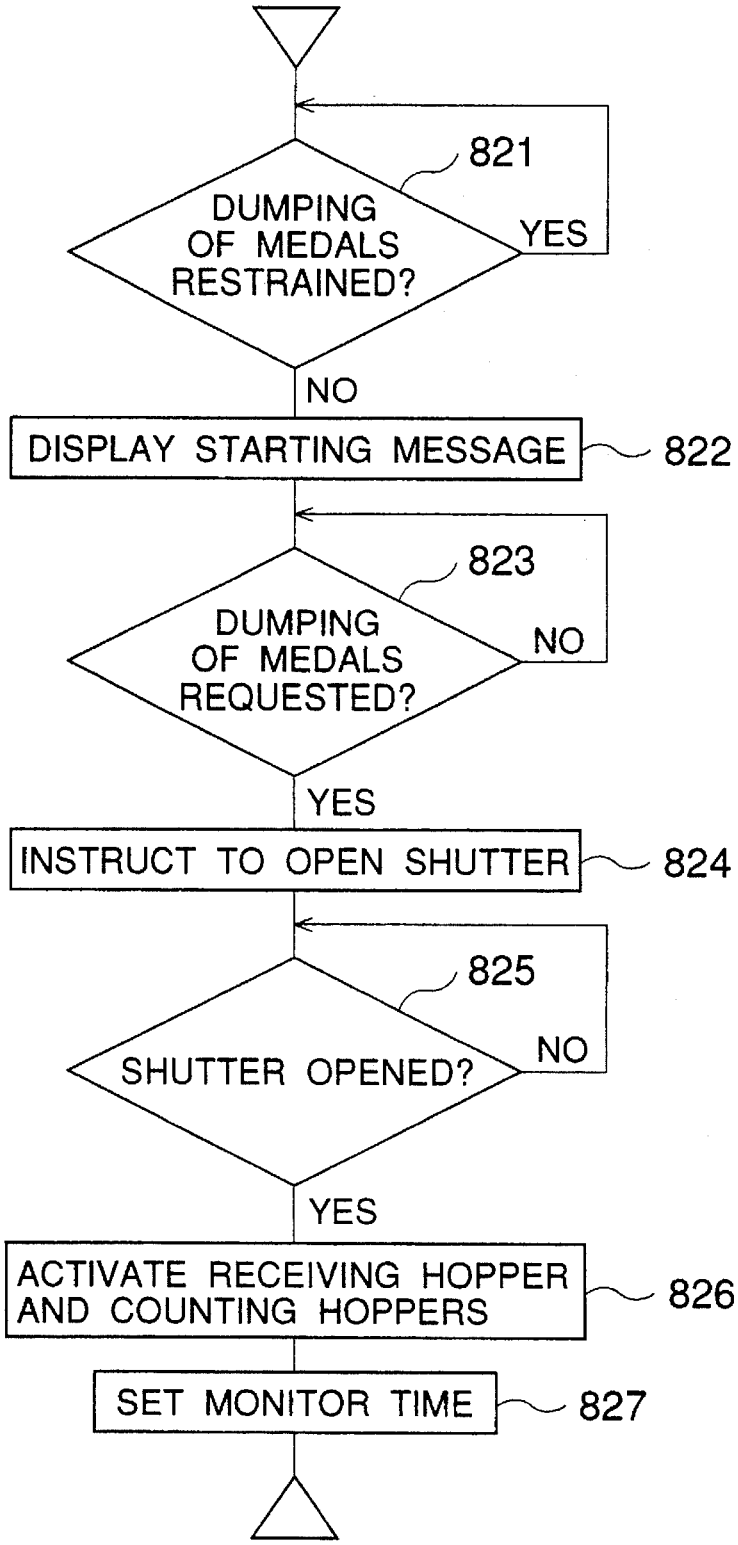
FIG. 9 is a flowchart showing a procedure of a starting process among the control operations of the control unit.

The starting process is carried out by the dump restraining control means 402 and the medal supply control means 403 as shown in FIG. 9. At first, the CPU 411 checks whether the medal dump restraining signal is input or not (Step 821). When dumping of medals is being restrained, the CPU 411 waits until the restraint is released. On the other hand, when dumping of medals is not restrained, the CPU 411 sends a message urging an user to start the apparatus, e.g., "Press Start Button", to the display section 450 by means of the display control means 404, for display on the liquid crystal display 452 (Step 822). It then stands by until the manipulating section 441 of the start requesting switch 440 is manipulated and a start request is input (Step 823). When the start request is input, the CPU 411 issues an instruction "Open Shutter" to the shutter driving circuit 430 (Step 824).

Then, the CPU 411 checks the output signal of the shutter closure detecting sensor 330 (Step 825) and when the shutter closure detecting sensor 330 outputs a signal indicating that the shutter plate 311 is starting to open, the CPU 411 activates the receiving hopper 210 and the counting hoppers 220 and 230 (Step 826). That is, it instructs the hopper driving circuit 420 to drive the motors 219, 226 and 236 which are the driving source of each hopper in the normal operation state. Then, a monitor time is set (Step 827). This monitor time is set at about five minutes, for example.

After that, the procedure advances to Step 830 shown in FIG. 8 and the CPU 411 sends display data of a message for informing the user that the apparatus is operational, e.g., "Operational", to the display section 450, for display on the liquid crystal display 452. Then, the CPU 411 determines whether or not the medal dump restraining signal and medal dump detecting signal have been input. When it determines that the medal dump restraining signal has been externally input, it executes a medal dump restraining process (Steps 840 and 900). When the medal dump detecting signal has been input from the medal dump detecting sensor 240, it executes a counting process (Steps 850 and 920). Then, when neither signal has been input by the time the preset monitor time elapses, the CPU 411 instructs to drive while saving power (Steps 860 and 870). By the way, the medal dump restraining signal is transmitted from outside as described above. It is, for example, an instruction from an administrative computer of the game parlor in which the medal counting apparatus is installed, or a manual instruction.

Figure 10:
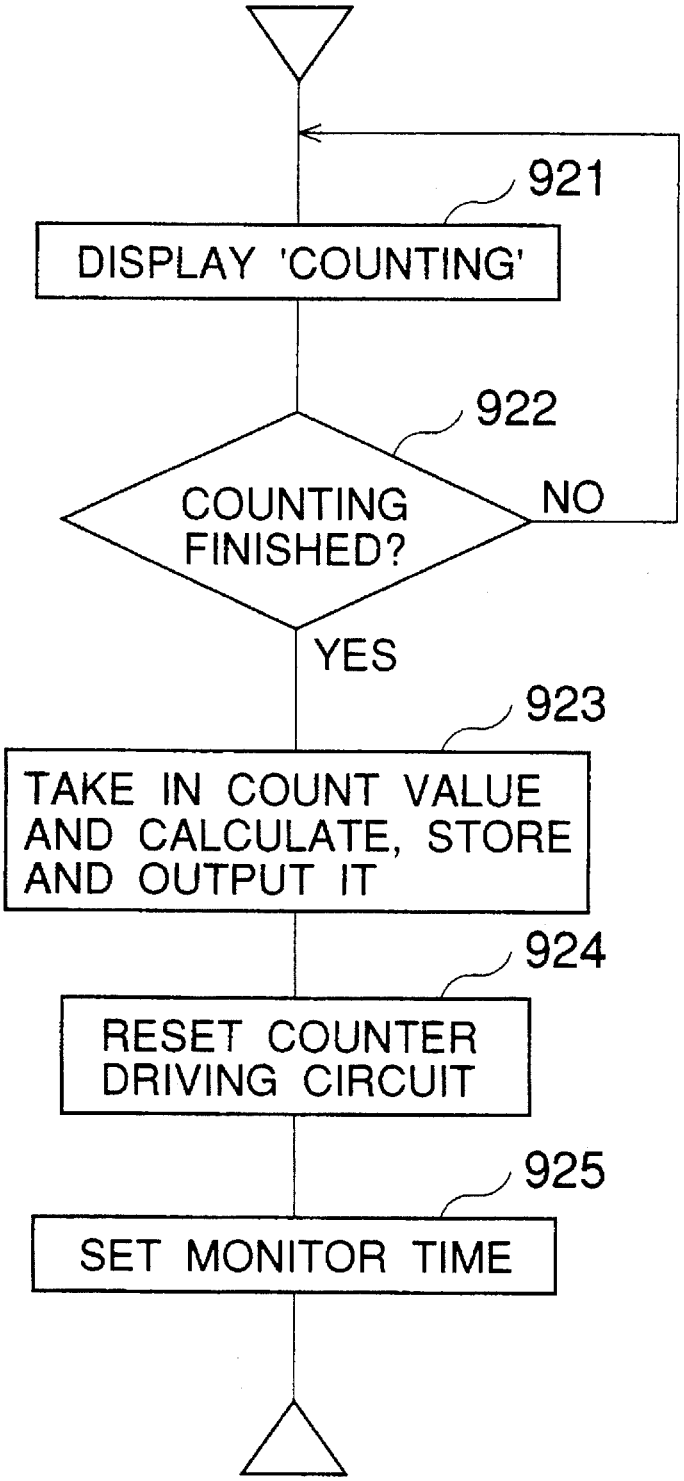
FIG. 10 is a flowchart showing a procedure of a counting operation among the control operations of the control unit.
Figure 11:
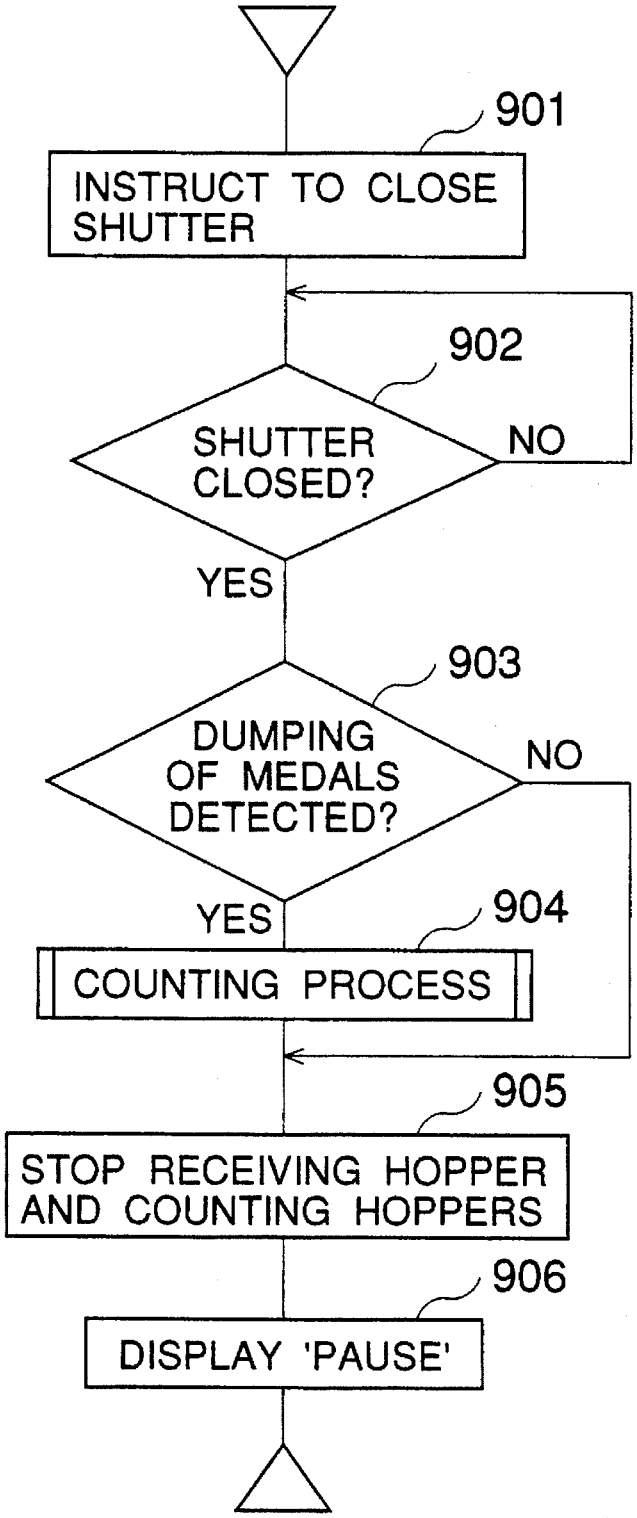
FIG. 11 is a flowchart showing a procedure of a dump restraining process among the control operations of the control unit.

When it is determined that the medal dump restraining signal has been input in Step 840, a medal dump restraining process is carried out by medal dump restraint processing means as shown in FIG. 11. That is, the CPU 411 instructs the shutter driving circuit 430 to close the shutter (Step 901). It also checks the signal to detect that the shutter is closed from the shutter closure detecting sensor 330 (Step 902) and when the shutter is closed, checks whether the medal dump detecting signal has been input by then (Step 903). When the medal dump detecting signal has been input, the counting process is carried out (Step 904). This counting process is carried out in the same manner as with the counting process shown in FIG. 10 which is described later.

Next, when no medal is dumped or the counting process in Step 904 is finished, the CPU 411 instructs the hopper driving circuit 420 to stop driving the receiving hopper 210 and the counting hoppers 220 and 230 (Step 905). Thereby, the medal counting apparatus is put into the stopped state as the shutter plate 311 is closed and the receiving hopper 210 and driving of the counting hoppers 220 and 230 is stopped.

Then, the CPU 411 causes the liquid crystal display 452 to display an indication of pause, e.g., "Pause", using the display control means 404. Furthermore, the CPU 411 checks whether there is an end instruction and if it is not the end, it returns to Step 820 to await being started (Step 910).

When medals are dumped into the receiving hopper 210, some of them pass through or are present at the space between the light emitting element 241 and the light receiving element 242 of the medal dump detecting sensor 240, blocking light from the light emitting element 241 from being input to the light receiving element 242. Thereby, the sensor driving circuit 243 can detect that the medals have been dumped from a change of the light receiving signal of the light receiving element 242. Accordingly, when the medal dump detecting signal is output from the medal dump detecting sensor 240 in Step 850, the counting process shown in FIG. 10 is carried out by the counter control means 401. That is, a display indicating that the medals are being counted, e.g., "Counting", is displayed on the liquid crystal display 452 using the display control means 404 (Step 921).

In the receiving hopper 210, the dumped medals are temporarily held at the dump section 211 and are conveyed in order from medals located below by the rotary disc 215 clockwise (in $\alpha$ direction) as shown by a sign A in FIG. 2 to be sent out to the counting hoppers 220 and 230 respectively through the discharge ports 217*a* and 217*b*. The rotary disc 221 rotates counter-clockwise (in $\beta$ direction) in the counting hopper 220 and the disc 231 rotates clockwise (in $\gamma$ direction) in the hopper 230. Accordingly, those medals sent out to the hoppers are respectively conveyed and approach the counter connecting sections 227 and 237. At this time, the medals are guided by the guide members 223 and 233 so as to advance in a direction tangential to the respective rotary discs 221 and 231. As a result, each medal is sent to the selection paths 110.

In each selection path 110, the medals are pulled in sequentially by the roller 114 which is driven and rotated by the motor 125 and move along the guide members 111*a* and 111*b*. At this time, the medals are restricted by the pressing member 113 so as not to rise. Here, medals having a diameter smaller than a width of the space between the guide members 111*a* and 111*b* drop at this section and are stored in the tank 532, going through the chute 531. On the other hand, the genuine medals pass through the selection path 110 and reach the conveyer 512 through the chute 511 to be conveyed to an intended location. When a genuine medal passes through near the edge of the selection path, the sensor 131 in the counting section detects its presence. That is, the presence of the medal is detected as the medal reflects light from a light emitting element 131*a* and a light receiving element 131*b* receives some of this reflected light. This detection signal is counted by the counter driving circuit 132.

By the way, because two counting sections are provided in the present embodiment, the counting may be carried out efficiently compared to a case when there is only one counting section.

During this time, the counter control means 401 checks the counter driving circuit 132 in the counting section 130 to determine whether the counting operation has been finished or not (Step 922). That is, the CPU 411 determines that the counting operation has finished when the count value of the counter driving circuit 132 is not zero and when it has not changed successively for a predetermined period of time. Here, the predetermined time is a time necessary for the medals dumped into the receiving hopper 210 to be counted. For example, it is set to be from 30 seconds to one minute, as described before.

After finishing the counting, the count value of each of the counter driving circuits 132 is taken in, added and stored in a region in the memory 412 for storing the current count value. Then, the CPU 411 reads out an accumulated count value up to then from the region in the memory 412 in order to store it, adds the current count value to it and updates the accumulated count value. It also causes the liquid crystal display 452 to display the current count value by means of the display control means 404. Further, it prints and outputs the current count value using the printer 460 (Step 923).

After that, the CPU 411 resets the counter driving circuit 132 (Step 924), sets a monitor time similarly to Step 827 shown in FIG. 9 (Step 925) and returns to Step 830.

Next, a case when the process advances to the step in which the power saving drive is instructed will be explained. In this case, the CPU 411 instructs the hopper driving circuit 420 to slow down the respective motors 219, 226 and 236 for the receiving hopper 210 and the counting hoppers 220 and 230 (Step 870). Thereby, those hoppers are operated in the slowdown state. At this time, the CPU 411 monitors an output from the medal dump detecting sensor 240 (Step 880). By the way, at this time, a monitor time is set to wait for the input of the medal dump detecting signal until such time elapses (Step 890). If the medal dump detecting signal is input before such time elapses, the procedure is shifted to the counting process 920 described above. On the other hand, if the time is over, the procedure is shifted to the medal dump restraining process 900 described above. The monitor time here may be appropriately set similarly to the aforementioned monitor time in Step 925. Here, the time is set at 10 minutes.

As described above, when it becomes necessary to count medals, the medal counting apparatus of the present invention enables counting of the medals by opening the shutter 310 based on the start requesting signal and by driving the receiving hopper 210, and the counting hoppers 220 and 230 so that they are put into the normal operation state before the medals are dumped in. When medals are not dumped successively for a certain period of time, i.e., when no counting is carried out successively for a certain period of time, this counting apparatus puts the drive of the receiving hopper 210, and the counting hoppers 220 and 230 into the power saving state. Still further, when medals are not dumped successively for a certain period of time, it closes the shutter and stops driving the receiving hopper 210 and the counting hoppers 220 and 230. When medals are dumped in, it puts the receiving hopper 210 and the counting hoppers 220 and 230 into the normal operation state even when those hoppers are being driven in the power saving state.

Accordingly, when no counting is carried out, the medal counting apparatus of the present invention stops driving the receiving hopper 210 and the counting hoppers 220 and 230. Then, because the receiving hopper 210 and the counting hoppers 220 and 230 are put into the power saving operation or stopped state, the power consumption may be reduced. Furthermore, the starting torque may be reduced when medals are dumped in because the receiving hopper 210 and the counting hoppers 220 and 230 are operated in the normal operation state or the power saving operation state and they don't need to be started from the state of repose.

Figure 12:
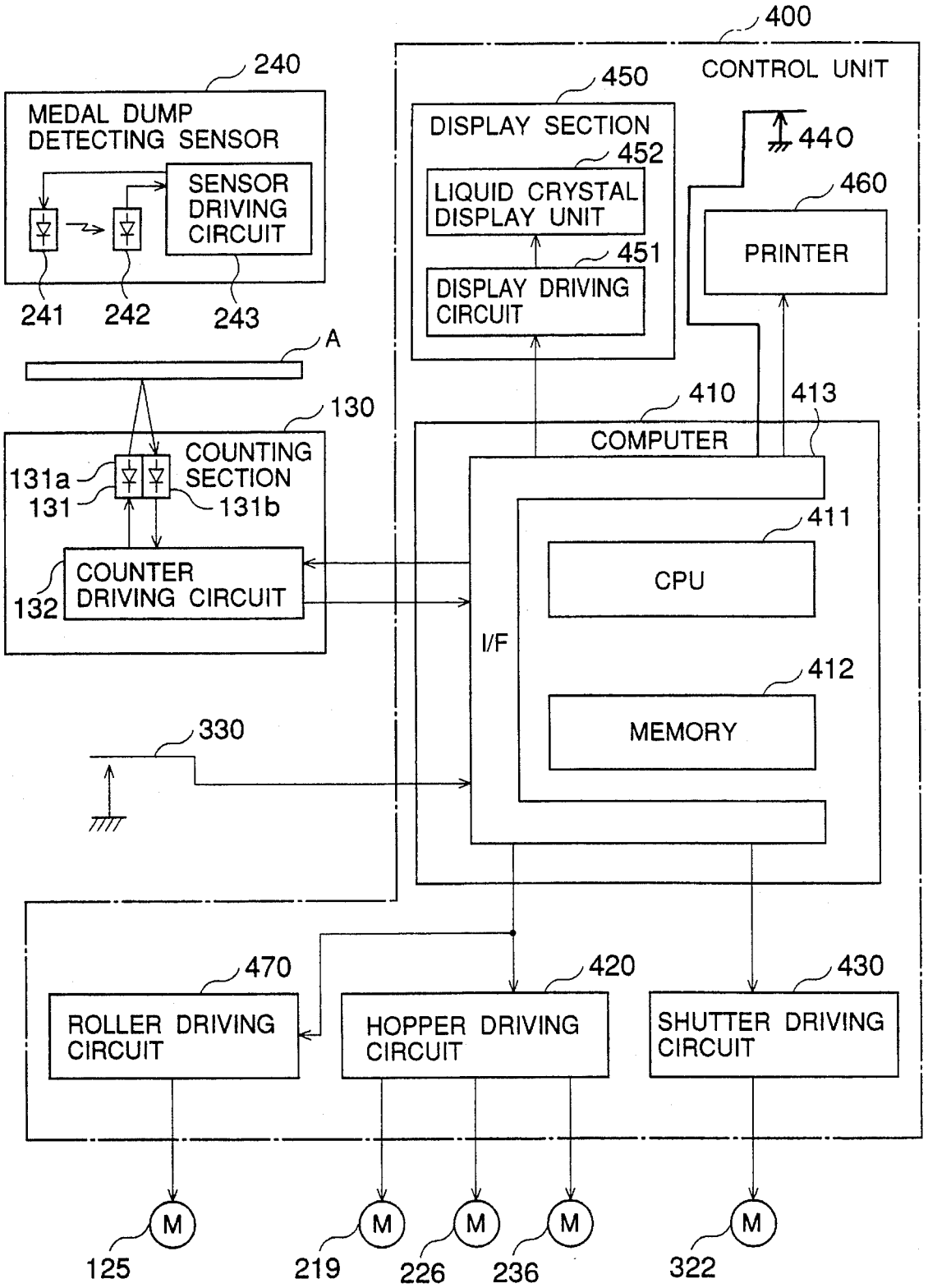
FIG. 12 is a block diagram illustrating another example of the medal counting apparatus of the present invention.

Although the case when the driving of the receiving hopper 210 and the counting hoppers 220 and 230 is stopped or is put into the power saving operation state has been explained in the description above, the present invention is not so limited. For example, it is possible to adapt the operation of the counter 100 so that it is also stopped or is put into the power saving operation state. For example, this is carried out by controlling the operation of the motor 125 to drive the roller 114 shown in FIG. 4. This control corresponds to the control of the drive of the receiving hopper 210 and the counting hoppers 220 and 230. Specifically, it may be realized by providing a roller driving circuit 470 in the control unit 400 and by controlling the roller driving circuit 470 in synchronization with the hopper driving circuit 420 as shown in FIG. 12. By constructing as described above, the power saving effect may be enhanced further. By the way, the other arrangement in FIG. 12 is the same as that shown in FIG. 7A.

Although a case when the medal dump detecting sensor 240 is an optical sensor having the light emitting element 241 and light receiving element 242 has been explained in the description above, the present invention is not confined only to that. The medal dump detecting sensor 240 may be a limit sensor which detects that medals are dumped by contacting with the dumped medals or an acoustic sensor which detects the same by detecting sound generated when the medals are dumped in.

While the preferred embodiments have been described, variations thereto will occur to those skilled in the art within the scope of the present inventive concepts which are delineated by the following claims.

What is claimed is:

1. A medal counting apparatus for counting dumped medals comprising:

a counter for counting the medals;

a medal supplying mechanism for receiving the medals to be dumped and for supplying them sequentially to said counter;

a dump restraining unit for restraining the medals from being dumped into said medal supplying mechanism; and a control unit having counter control means for controlling operation of said counter, medal supply control means for controlling operation of said medal supplying mechanism, and dump restraining control means for controlling operation of said dump restraining unit;

said medal supply control means putting said medal supplying mechanism into a stopped state when said dump restraining unit restrains the medals from being dumped and into an operation state when said dump restraining unit permits dumping of the medals.

2. The medal counting apparatus as claimed in claim 1 wherein said medal supplying mechanism comprises: a receiving hopper, having an opening for receiving medals, said receiving hopper discharging the medals dumped in said opening bit by bit; and at least one counting hopper for receiving the medals sent from said receiving hopper and for sending the medals to said counter one by one.

3. The medal counting apparatus as claimed in claim 2 wherein said dump restraining unit comprises:

a shutter and associated driving mechanism for closing said opening of said receiving hopper; and a shutter closure detecting sensor for detecting at least that said shutter is closed;

said dump restraining control means instructing said dump restraining unit to open said shutter when a medal dump requesting signal is externally input; and said medal supply control means receiving an output signal of said shutter closure detecting sensor and switching the state of said receiving hopper and counting hopper from the stopped state to the operation state when said shutter starts to open.

4. The medal counting apparatus as claimed in claim 3 wherein said dump restraining control means stops accepting the input of the medal dump requesting signal from the outside when a medal dump restraining signal is externally input until such medal dump restraining signal is removed.

5. The medal counting apparatus as claimed in claim 3 wherein said counter control means comprises:

means for taking in an output of said counter to check whether or not a counting operation has been finished;

means for taking in a count value from said counter to store said count value when the counting operation has been finished;

means for outputting the stored count value to the outside; and means for resetting said counter.

6. The medal counting apparatus as claimed in claim 3 wherein said medal supplying mechanism further comprises a medal dump detecting sensor for detecting that medals are being dumped into said receiving hopper.

7. The medal counting apparatus as claimed in claim 6 wherein said dump restraining control means instructs said dump restraining unit to close said opening of said receiving hopper when a medal dump restraining signal is externally input; and said medal supply control means receives an output signal of said shutter closure detecting sensor and an output signal of said medal dump detecting sensor, determines whether medals have been dumped during a time after the instruction to close said opening of said receiving hopper has been issued and before said shutter is closed, and when no medal has been dumped, stops the operation of said receiving hopper and counting hopper.

8. The medal counting apparatus as claimed in claim 7 wherein the operation of said receiving hopper and counting hopper is stopped after counting is finished when medals have been dumped during the time after the instruction to close said opening of said receiving hopper has been issued and before said shutter is closed.

9. The medal counting apparatus as claimed in claim 6 wherein said medal supply control means receives an output signal of said medal dump detecting sensor and when a state in which no medal dumping is detected continues for a predetermined first time, switches the operation state of said receiving hopper and counting hopper from a normal operation state to an operation state in which power consumption is reduced.

10. The medal counting apparatus as claimed in claim 9 wherein said medal supply control means puts said receiving hopper and counting hopper into the normal operation state when said medal dump detecting sensor detects that medals are dumped when said receiving hopper and counting hopper are in the operation state in which the power consumption is reduced.

11. The medal counting apparatus as claimed in claim 9 wherein said dump restraining control means instructs said dump restraining unit to close said opening of said receiving hopper when said receiving hopper and counting hopper are in the operation state in which the power consumption is reduced when a state in which said medal dump detecting sensor detects no medal to be dumped continues for a predetermined second time; and said medal supply control means receives an output signal of said shutter closure detecting sensor and an output signal of said medal dump detecting sensor, determines whether medals have been dumped during a time after the instruction to close said opening of said receiving hopper has been issued and before said shutter is closed and when no medal has been dumped, stops the operation of said receiving hopper and counting hopper.

12. The medal counting apparatus as claimed in claim 3 wherein said medal supply control means switches the operation state of said receiving hopper and counting hopper from a normal operation state to an operation state in which power consumption is reduced when a state in which no medal is detected or being dumped continues for a predetermined time.

13. The medal counting apparatus as claimed in claim 12 wherein said dump restraining control means instructs said dump restraining unit to close said opening of said receiving hopper when said counter successively executes no counting operation for a predetermined period of time; and said medal supply control means receives an output signal of said shutter closure detecting sensor and stops the operation of said receiving hopper and counting hopper when said counter successively executes no counting operation for a predetermined period of time after said shutter is closed.

14. The medal counting apparatus as claimed in claim 3 wherein said counter comprises a selection path for excluding small medals and a counting section for counting medals which have passed through said selection path;

said selection path comprising: a pair of guide members disposed so that a space between said pair of guide members is insufficient for genuine medals to drop therethrough but is sufficient to allow the small medals to drop, the medals being guided by placing the medals on said pair of guide members in a flat state; a pair of guide plates which are disposed respectively on the outside of said pair of guide members with a space which permits the genuine medals to pass through; and a roller and its driving mechanism disposed above said pair of guide members to send the medals along said guide members.

15. The medal counting apparatus as claimed in claim 11 wherein said counter comprises a selection path for excluding small medals and a counting section for counting medals which passed through said selection path;

said selection path comprising: a pair of guide members disposed so that a space between said pair of guide members is insufficient for genuine medals to drop therethrough but is sufficient to allow the small medals to drop, the medals being guided by placing medals on said pair of guide members in a flat state; pair of guide plates which are disposed respectively on the outside of said pair of guide members with a space which permits the genuine medals to pass through; and a roller and its driving mechanism disposed above said pair of guide members to send the medals along said guide members;

said medal supply control means putting a roller driving control circuit into an operation state in which the power consumption is reduced or into the stopped state in synchronization with said receiving hopper and counting hopper.

16. The medal counting apparatus as claimed in claim 1 comprising:

a medal supplying mechanism for supplying the dumped medals sequentially to said counter; and said counter comprises a selection path for excluding small medals and a counting section for counting medals which have passed through said selection path;

said selection path comprising: a pair of guide members disposed so that a space between said pair of guide members is insufficient for genuine medals to drop therethrough but is sufficient to allow the small medals to drop, the medals being guided by placing medals on said pair of guide members in a flat state; a pair of guide plates which are disposed respectively on the outside of said pair of guide members with a space which permits the genuine medals to pass through; and a roller and its driving mechanism disposed above said pair of guide members to send the medals on said guide members;

said medal supplying mechanism comprising: a receiving hopper having an opening for receiving the medals being dumped and for discharging the medals bit by bit; and at least one counting hopper for receiving the medals sent from said receiving hopper for forwarding them to said counter one by one.

17. The medal counting apparatus as claimed in claim 16 wherein said selection path further includes a pressing member disposed above said pair of guide members to prevent the medals on said guide members from rising.

18. The medal counting apparatus as claimed in claim 16 wherein a plurality of said counters and counting hoppers are provided and each receiving hopper is provided with a communication port to each of said counting hoppers at position corresponding to the position of respective counting hoppers.

19. The medal counting apparatus as claimed in claim 18 wherein each of said receiving hopper and counting hoppers has a rotary disc, and each of said communication ports is disposed at the circumference of said rotary disc in said receiving hopper, and one end of said selection path is disposed at a portion of the circumference of said rotary disc in each of said counting hoppers.

* * * * *